US009941063B2

(12) United States Patent
Takahashi et al.

(10) Patent No.: US 9,941,063 B2
(45) Date of Patent: Apr. 10, 2018

(54) LIMIT SWITCH AND METHOD FOR PRODUCING SAME

(75) Inventors: Manabu Takahashi, Okayama (JP); Kazuyuki Tsukimori, Okayama (JP); Shigenobu Fukui, Tottori (JP); Hiroyuki Moriyama, Tottori (JP); Yuichi Ishikawa, Okayama (JP)

(73) Assignee: OMRON Corporation, Kyoto (JP)

( * ) Notice: Subject to any disclaimer, the term of this patent is extended or adjusted under 35 U.S.C. 154(b) by 163 days.

(21) Appl. No.: 14/368,817

(22) PCT Filed: Mar. 15, 2012

(86) PCT No.: PCT/JP2012/056660

§ 371 (c)(1),
(2), (4) Date: Jul. 24, 2014

(87) PCT Pub. No.: WO2013/105278

PCT Pub. Date: Jul. 18, 2013

(65) Prior Publication Data

US 2014/0360849 A1 Dec. 11, 2014

(30) Foreign Application Priority Data

Jan. 13, 2012 (JP) ..... 2012-005436

(51) Int. Cl.

| | |
|---|---|
| ***H01H 3/42*** | (2006.01) |
| ***H01H 21/28*** | (2006.01) |
| ***H01H 11/00*** | (2006.01) |

(52) U.S. Cl.

CPC ..... *H01H 3/42* (2013.01); *H01H 11/00* (2013.01); *H01H 21/285* (2013.01); *H01H 2235/01* (2013.01); *Y10T 29/49105* (2015.01)

(58) Field of Classification Search

CPC ..... H01H 11/0006; H01H 1/58; H01H 21/28; H01H 21/285; H01H 3/16; H01H 13/18;

(Continued)

(56) References Cited

U.S. PATENT DOCUMENTS

| | | | |
|---|---|---|---|
| 3,126,460 | A | 3/1964 | Dufour |
| 3,512,422 | A | 5/1970 | Asian |

(Continued)

FOREIGN PATENT DOCUMENTS

| | | | |
|---|---|---|---|
| EP | 0483825 | A2 | 5/1992 |
| FR | 79640 | E | 12/1962 |

(Continued)

OTHER PUBLICATIONS

International Search Report for corresponding International Application No. PCT/JP2012/056660, dated May 22, 2012 (4 pages).

(Continued)

*Primary Examiner* — Ahmed Saeed
(74) *Attorney, Agent, or Firm* — Osha Liang LLP

(57) ABSTRACT

A limit switch having a housing having a box, an attachment hold made in a side surface of the box, having a cylindrical bearing section, a rotating shaft rotatably inserted through the cylindrical bearing section, a cam unit provided in a leading end portion of the rotating shaft, and an operation lever provided in the other end portion of the rotating shaft. Rotational action of the operation lever is converted into vertical action by the cam unit in the box. A contact of a switch main body accommodated in and fixed to the housing is opened and closed. An outer diameter of the cam unit is smaller than an inner diameter of the attachment hole.

5 Claims, 9 Drawing Sheets

(58) Field of Classification Search
CPC .... H01H 2021/287; H01H 3/42; H01H 19/18; H01H 2231/038
USPC ..... 200/47, 332, 573, 338
See application file for complete search history.

(56) References Cited

U.S. PATENT DOCUMENTS

| | | | | |
|---|---|---|---|---|
| 3,740,504 A | | 6/1973 | Hippie | |
| 5,207,316 A | | 5/1993 | Sakamoto | |
| 5,430,264 A | * | 7/1995 | Shinohara | H01H 21/285 200/329 |

FOREIGN PATENT DOCUMENTS

| | | | | |
|---|---|---|---|---|
| JP | 40-25695 B1 | | 11/1965 | |
| JP | 55-106928 U | | 7/1980 | |
| JP | 2-82842 U | | 6/1990 | |
| JP | 4-324213 A | | 11/1992 | |
| JP | H11238430 | * | 8/1999 | H01H 21/285 |
| JP | 2000-003636 A | | 1/2000 | |

OTHER PUBLICATIONS

Extended European Search Report issued in corresponding European Application No. 12864970.4, dated Jul. 30, 2015 (6 pages).
First Office Action issued in corresponding Chinese Application No. 201280064235.6, dated Jul. 17, 2015 (11 pages).
Notification of Reasons for Refusal issued in corresponding Japanese Application No. 2012-005436, dated Sep. 8, 2015 (9 pages).

* cited by examiner (A)

(B)

LIMIT SWITCH AND METHOD FOR PRODUCING SAME

BACKGROUND

Technical Field

The present invention relates to a limit switch, particularly to a head section of the limit switch and a method for producing the limit switch.

Related Art

Conventionally, for example, in the case that a head section constituting a driving mechanism of a limit switch is assembled, as illustrated in FIGS. 4, 5A, and 5B of Patent Document 1, a head case is vertically inserted while a cam unit including a cam member and a return spring is held with a jig, and a shaft is laterally inserted in the head case to attach the cam unit to a leading end portion of the shaft.

Patent Document 1: Japanese Unexamined Patent Publication No. 4-324213

SUMMARY

However, in the conventional limit switch, the shaft or a bearing is laterally inserted in the head case while the cam unit is fixed with the jig, and it takes a lot of work to assemble the limit switch, which results in low productivity.

One or more embodiments of the present invention provides a high-productivity limit switch in which the head section constituting the driving mechanism is easy to assemble, and a method for producing same.

In accordance with one or more embodiments of the present invention, a limit switch, in which a rotating shaft is rotatably inserted through a cylindrical bearing section in an attachment hole made in a side surface of a box partially constituting a housing, a cam unit is provided in a leading end portion of the rotating shaft while an operation lever is provided in the other end portion, rotational action of the operation lever is converted into vertical action by the cam unit included in the box, and a contact of a switch main body accommodated in and fixed to the housing is opened and closed. In the limit switch, an outer diameter of the cam unit is smaller than an inner diameter of the attachment hole.

According to one or more embodiments of the present invention, the outer diameter of the cam unit is smaller than the inner diameter of the attachment hole, so that the cam unit can be inserted in the box through the attachment hole after previously attached to the rotating shaft during the assembly of the driving mechanism of the limit switch. That is, the cam unit can be assembled in the box while attached to the rotating shaft. Therefore, there is no necessity of fixing the cam unit with the jig, and the assembly work of the head section constituting the driving mechanism can be facilitated to provide the limit switch with high productivity.

In accordance with one or more embodiments of the present invention, in the limit switch, the outer diameter of the cam unit may be larger than an inner diameter of the cylindrical bearing section.

According to one or more embodiments of the present invention, the cam unit abuts on the cylindrical bearing section, which allows the rotating shaft and the cam unit to be retained in the housing.

In accordance with one or more embodiments of the present invention, in the limit switch, the cam unit may include a pair of circular cams and a return spring sandwiched between the circular cams.

According to one or more embodiments of the present invention, functions of the pair of circular cams can be varied, and external forces in different directions can be detected.

In accordance with one or more embodiments of the present invention, a method for producing a limit switch, in which a rotating shaft is rotatably inserted through a cylindrical bearing section in an attachment hole made in a side surface of a box partially constituting a housing, a cam unit is provided in a leading end portion of the rotating shaft while an operation lever is provided in the other end portion, rotational action of the operation lever is converted into vertical action by the cam unit included in the box, and a contact of a switch main body accommodated in and fixed to the housing is opened and closed, the limit switch producing method includes the step of fitting the cylindrical bearing section in the attachment hole to rotatably support the rotating shaft after the rotating shaft in which the cam unit is provided in the leading end portion is inserted in the attachment hole.

According to one or more embodiments of the present invention, the rotating shaft in which the cam unit is inserted in the leading end portion can be fitted in the attachment hole through the cylindrical bearing section. That is, the cam unit can be assembled in the box while attached to the rotating shaft. There is no necessity of fixing the cam unit with the jig, but all the members of the head section constituting the driving mechanism can be attached from one direction. Therefore, the assembly work can be facilitated to provide the limit switch with high productivity.

DETAILED DESCRIPTION

Hereinafter, embodiments of the present invention will be described with reference to FIGS. 1 to 9. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
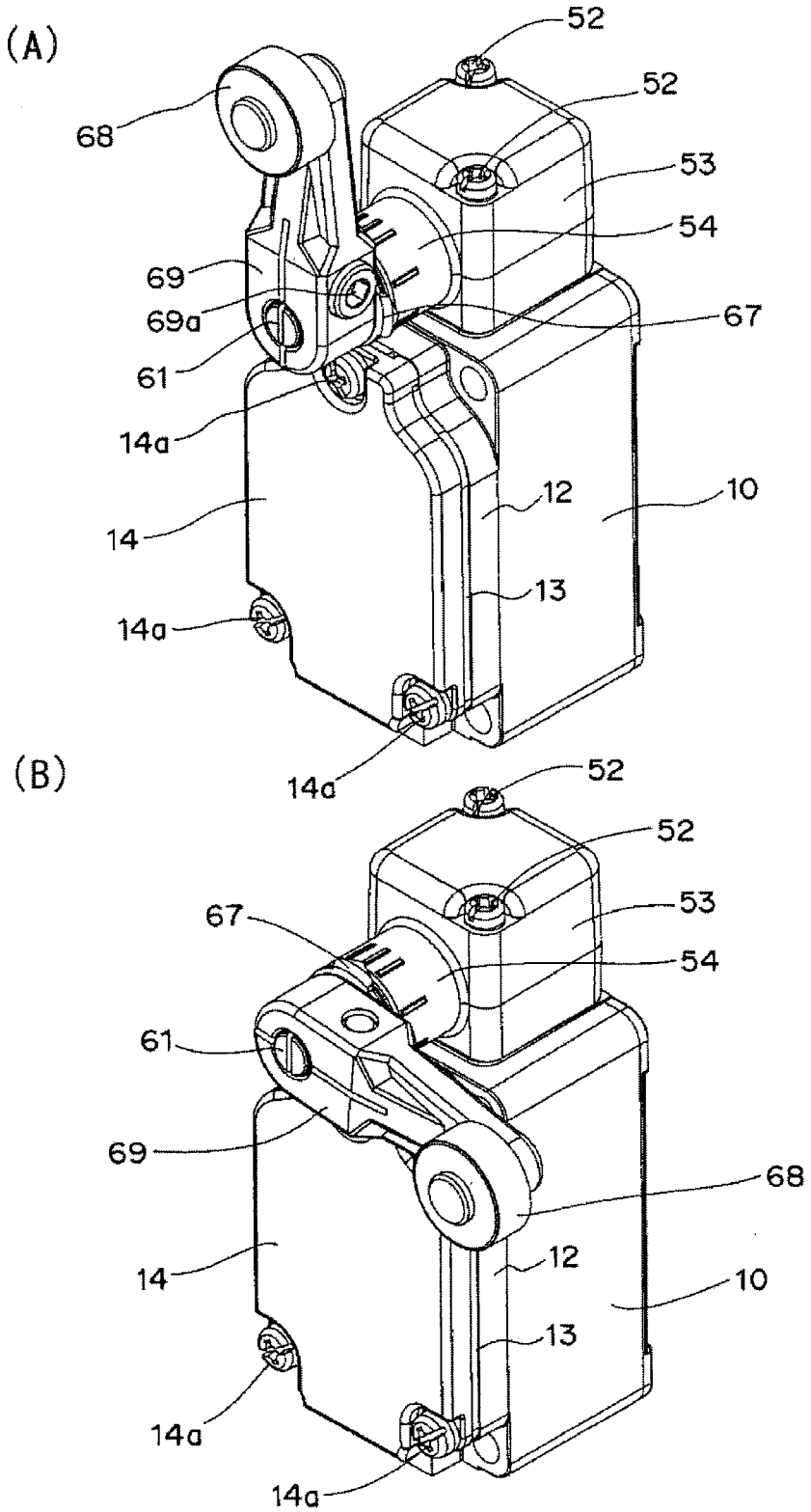
FIGS. 1A and 1B are perspective views illustrating before-and-after action of a limit switch according to a first embodiment of the present invention.
Figure 2:
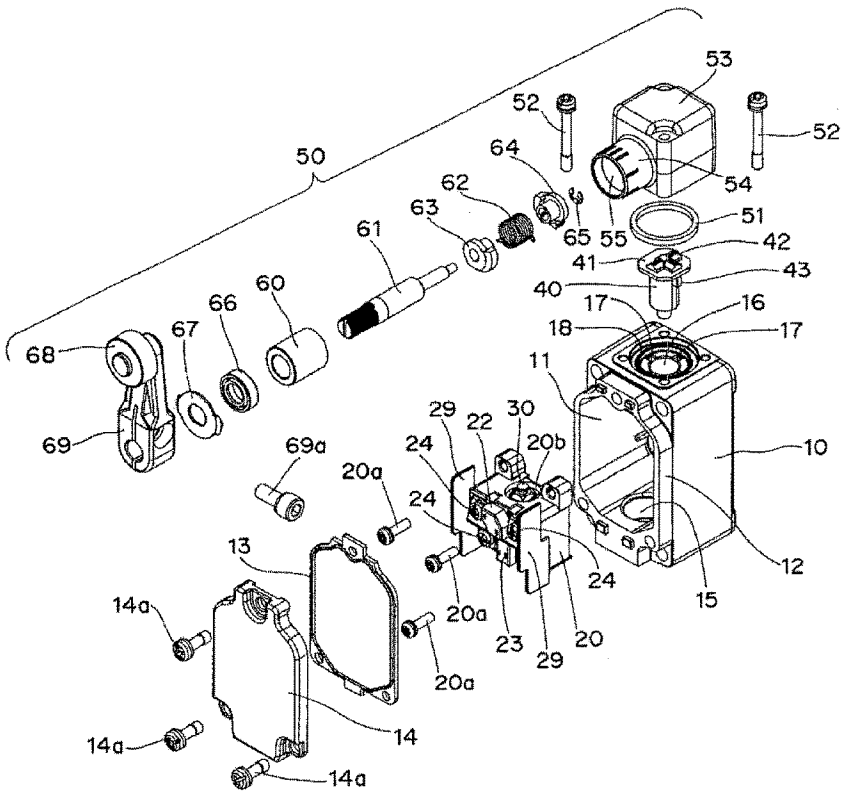
FIG. 2 is an exploded perspective view of the limit switch in FIG. 1.
Figure 3:
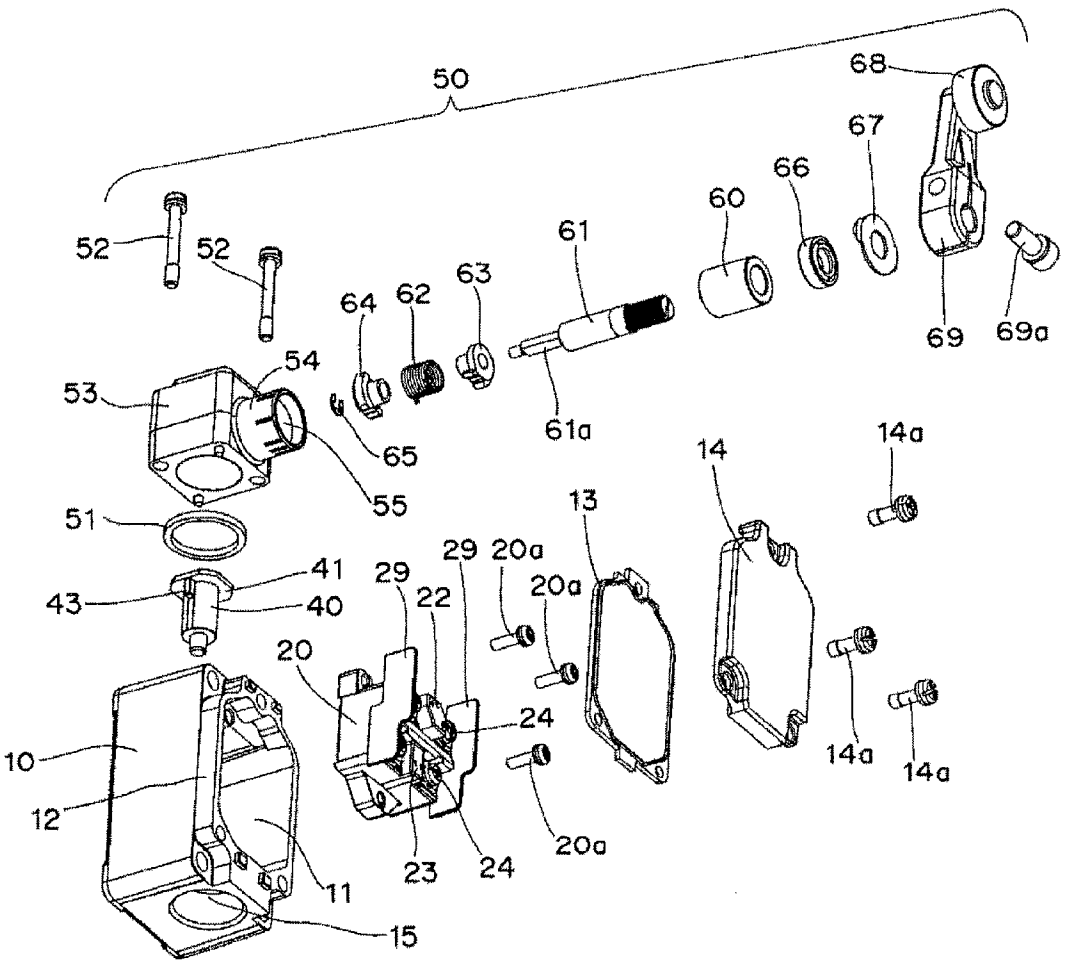
FIG. 3 is an exploded perspective view of the limit switch in FIG. 1 when viewed from a different angle.

As illustrated in FIGS. 1 to 3, in a limit switch according to a first embodiment, switch main body 20 assembled in housing 10 is driven by driving mechanism 50 including operation lever 69 through plunger 40.

Housing 10 has a box shape in which switch main body 20 can be accommodated, and circular rib 12 is formed along opening 11 provided in a front surface of housing 10. Circular seal member 13 is positioned in circular rib 12, and cover 14 is fixed to housing 10 by fixing screws 14*a*, thereby sealing opening 11. Connection hole 15 is made in a bottom surface of housing 10, and operation hole 16 is made in a ceiling surface of housing 10. Positioning slits 17 are radially formed in an inner circumferential surface of operation hole 16 at intervals of 90 degrees, and circular step 18 is concentrically formed near an opening edge of operation hole 16.

Switch main body 20 has an outer shape of which switch main body 20 can be accommodated from opening 11 of housing 10, and switch main body 20 is fixed to an inside surface of housing 10 by three fixing screws 20*a*.

Figure 4:
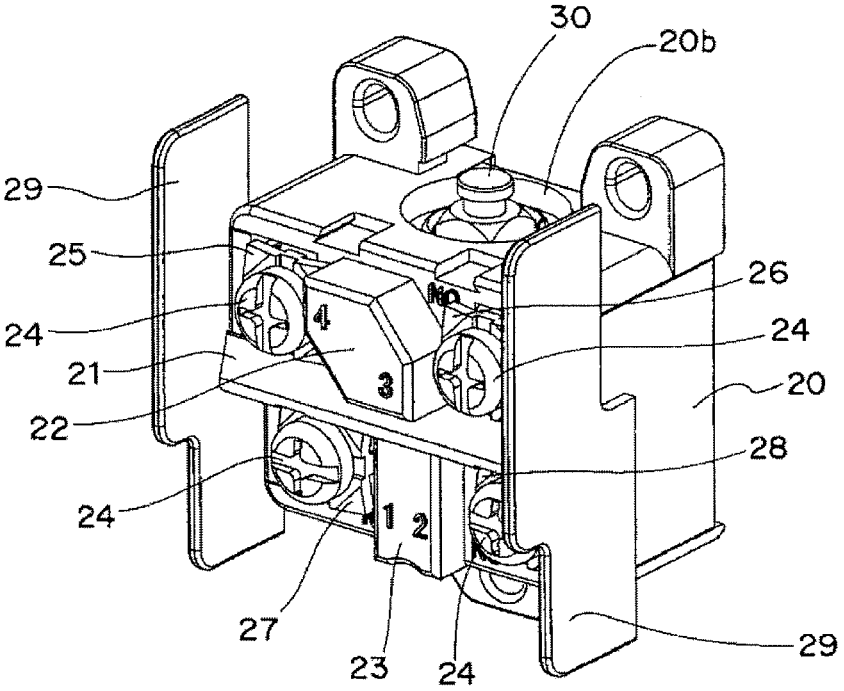
FIGS. 4A and 4B are an enlarged perspective view and a longitudinal sectional view of a switch main body in FIG. 2.
Figure 4:
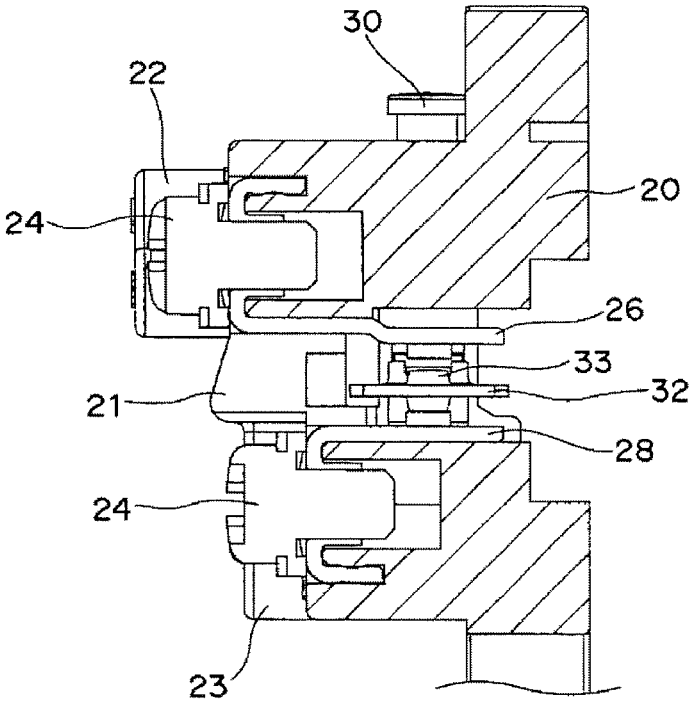
Figure 5:
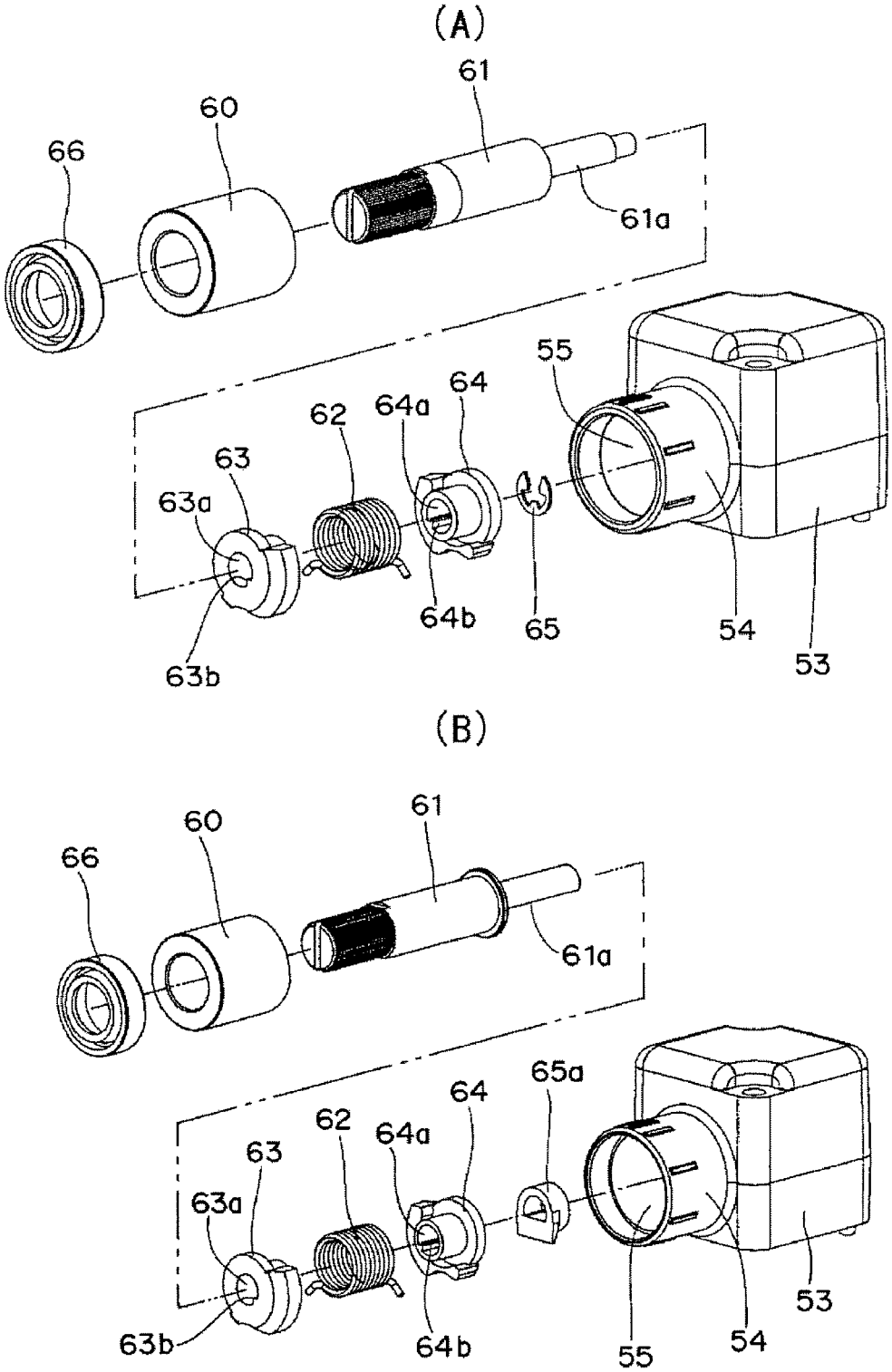
FIG. 5A is a partially exploded perspective view of a driving mechanism in FIG. 2.
FIG. 5B is a partially exploded perspective view illustrating a driving mechanism according to a second embodiment of the present invention.

As illustrated in FIG. 4, the front surface of switch main body 20 is vertically partitioned into two stages by partition rib 21, hexagonal first projection 22 is obliquely projected in a center of the upper stage, and square second projection 23 is projected in the center of the lower stage. Fixed contact terminals 25 and 26, each of which includes connection screw 24 and has a substantial U-shape in section, are embedded on both sides of first projection 22, and fixed contact terminals 27 and 28 including connection screw 24 are embedded on both sides of second projection 23. Switch main body 20 is provided such that insulating walls 29 and 29 are pushed out onto a front side from end portions on both the sides of switch main body 20.

Figure 8:
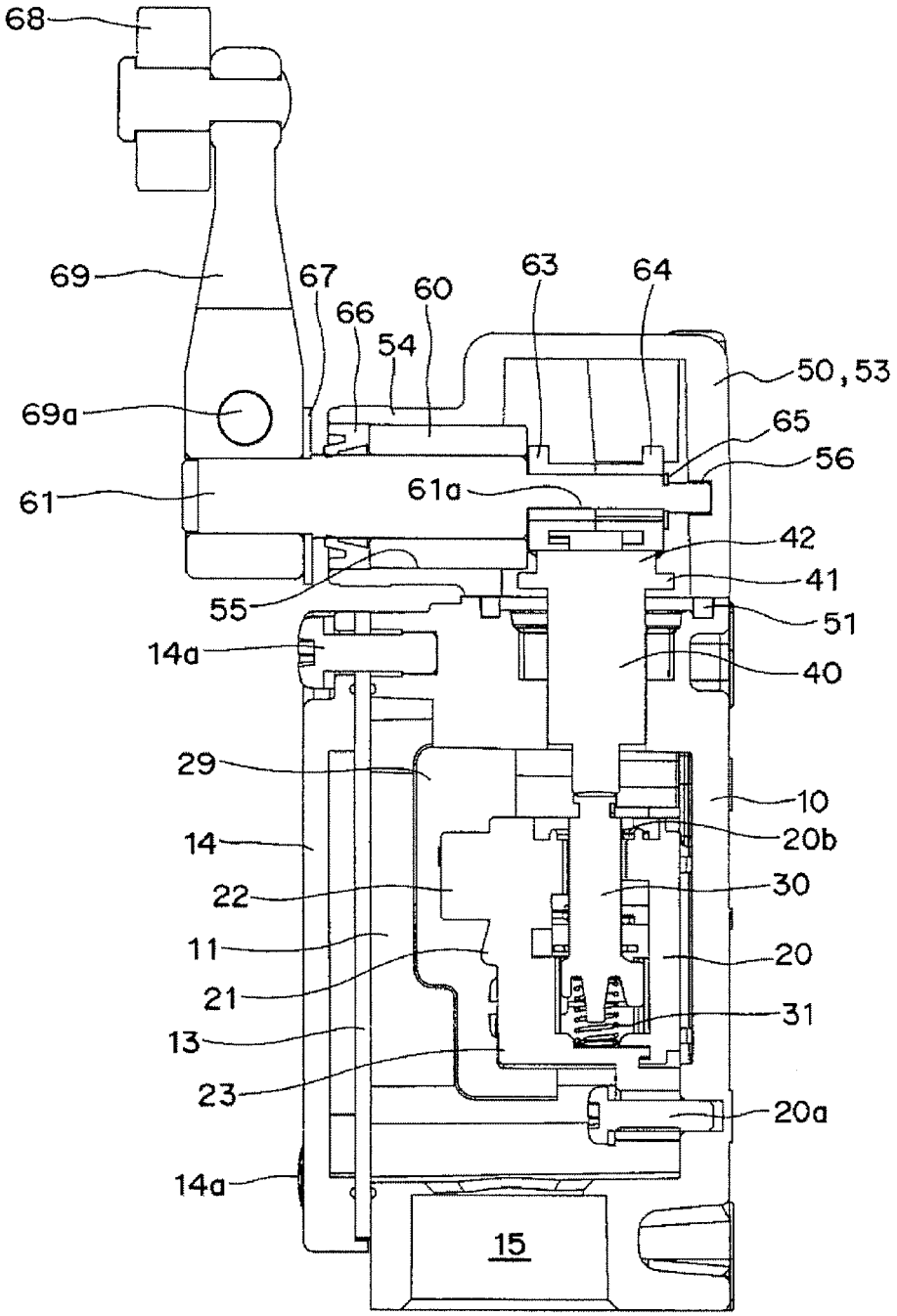
FIG. 8 is a longitudinal sectional view illustrating a center of the limit switch in FIG. 1 before the action.
Figure 9:
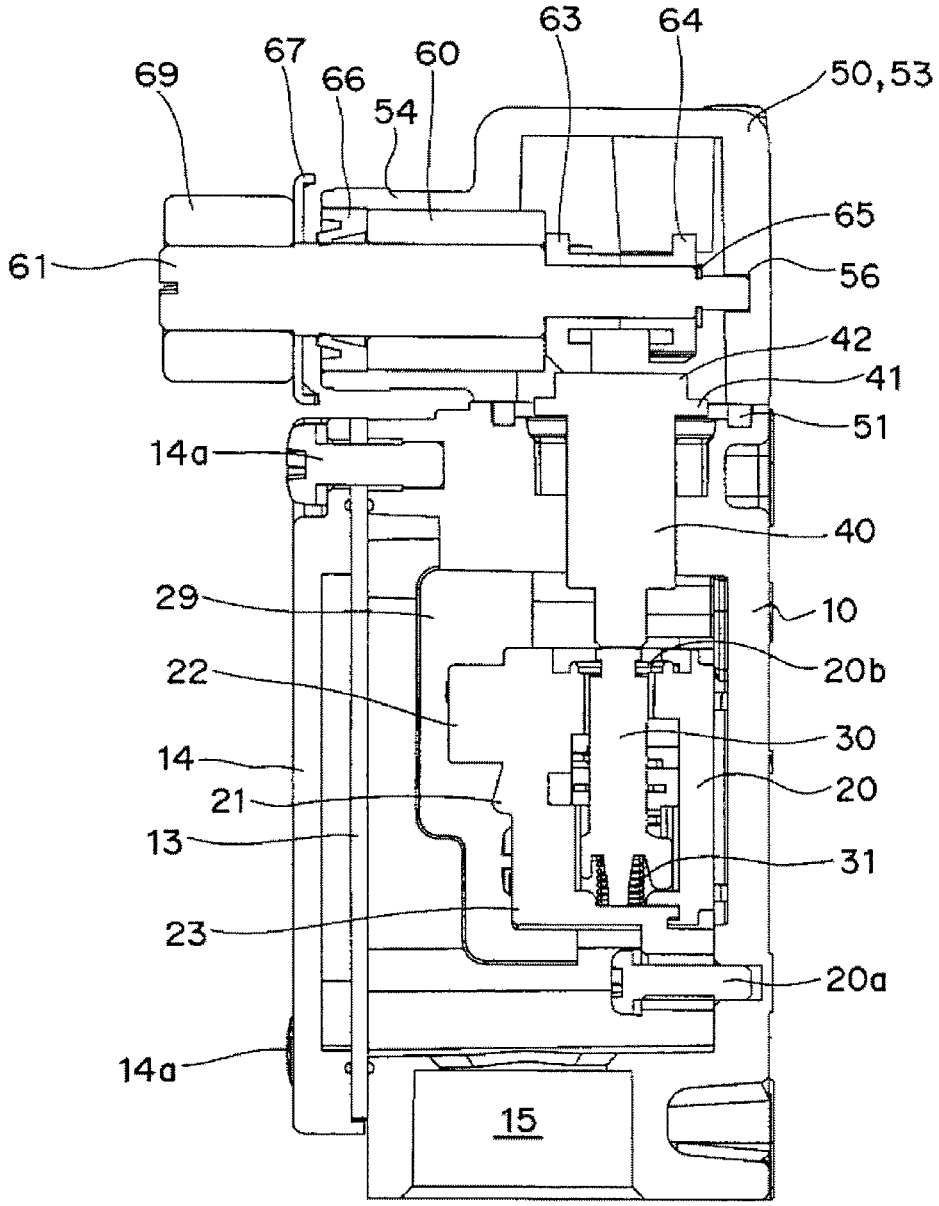
FIG. 9 is a longitudinal sectional view illustrating the center of the limit switch in FIG. 1 after the action.

As illustrated in FIGS. 8 and 9, operation shaft 30 is supported in switch main body 20 while being vertically slidable, and operation shaft 30 is biased upward by coil spring 31. Therefore, an upper end of operation shaft 30 projects from operation hole 20*b* made in the ceiling surface of switch main body 20. In operation shaft 30, movable touch piece 32 in FIG. 4 is vertically inverted, whereby movable contacts 33 provided at both ends of movable touch piece 32 alternately comes into contact with and separates from fixed contacts of fixed contact terminals 25 and 26 and fixed contacts of fixed contact terminals 27 and 28.

As illustrated in FIGS. 2 and 3, plunger 40 has the outer shape that can vertically move along operation hole 16 of housing 10, operating ridge 42 having a substantial T-shape is provided in an upper surface of guard portion 41 of plunger 40, and guide rib 43 is provided in a base of a lower surface of guard portion 41. Guide rib 43 of plunger 40 is selectively fitted in one of positioning slits 17 provided in housing 10, whereby a lower end of plunger 40 abuts on an upper end of operation shaft 30 to be able to detect a rotation direction of operation lever 69 which is described below.

As illustrated in FIG. 2, driving mechanism 50 is assembled in box 53 that is fixed to the upper surface of housing 10 with seal ring 51 interposed therebetween by fixing screws 52. Box 53 constitutes the head section as a part of housing 10.

That is, as illustrated in FIG. 8, rotating shaft 61 is rotatably inserted in cylindrical bearing section 60 that is press-fixed through attachment hole 55 of cylindrical rib 54 provided in box 53. The leading end portion of rotating shaft 61 is fitted in bearing recess 56 provided in the inside surface of box 53, and a pair of circular cams 63 and 64 sandwiching return coil spring 62 is retained on a leading end side of rotating shaft 61 by E-ring 65 (for the sake of convenience, return coil spring 62 is not illustrated in FIGS. 8 and 9).

Particularly, as illustrated in FIG. 5A, the circular cams 63 and 64 respectively include through-holes 63*a* and 64*a* that can be fitted in the leading end portion of rotating shaft 61 in which flat surface 61*a* (FIG. 3) is provided. Ridges 63*b* and 64*b* having a triangular shape in section are projected along a shaft center direction in the inner circumferential surfaces of through-holes 63*a* and 64*a*, respectively, and ridges 63*b* and 64*b* can be latched in an edge of flat surface 61*a* of rotating shaft 61. Both the ends of return coil spring 62 are latched in circular cams 63 and 64 to provide a biasing force in the rotation direction to rotating shaft 61. This is because operation lever 69, which is described later, is returned to an original position. Return coil spring 62 and circular cams 63 and 64 constitute the cam unit of one or more embodiments of the present invention, and diameters of return coil spring 62 and circular cams 63 and 64 are smaller than a diameter of cylindrical rib 54 (see FIG. 8). Therefore, rotating shaft 61 can unidirectionally be inserted in box 53 through attachment hole 55 after circular cam 63, return coil spring 62, and circular cam 64 are sequentially inserted on the leading end side of rotating shaft 61. Because an outer diameter of circular cam 63 is larger than an inner diameter of cylindrical bearing section 60, cylindrical bearing section 60 abuts on an outward surface of circular cam 63. As a result, rotating shaft 61 is retained.

On the other hand, as illustrated in FIG. 2, rubber oil seal 66 is mounted on the rear end side of rotating shaft 61 projecting from cylindrical rib 54, and setting position display panel 67 is engaged with the rear end side of rotating shaft 61. Operation lever 69 including roller 68 is fixed to the rear end of rotating shaft 61 by adjustment screw 69*a*.

Not only circular cams 63 and 64 are fixed by E-ring 65, but also circular cams 63 and 64 may be retained by stopper 65*a* press-fixed into the leading end portion of rotating shaft 61 like a second embodiment in FIG. 5B. Because other configurations of the second embodiment are similar to those of the first embodiment, the same component is designated by the same numeral, and the description is omitted.

A method for assembling the limit switch having the above constituent will be described below.

Switch main body 20 is inserted from opening 11 of housing 10, and fixed by three fixing screws 20*a*. On the other hand, guide rib 43 of plunger 40 is selectively fitted in positioning slit 17 provided in operation hole 16 of housing 10. Seal ring 51 is fitted in circular step 18 provided around operation hole 16, and box 53 is fixed to housing 10 by fixing screws 52.

On the other hand, circular cam 63, return coil spring 62, and circular cam 64 are sequentially inserted on the leading end side of rotating shaft 61, and retained by E-ring 65. Rotating shaft 61 is inserted from attachment hole 55 of box 53. Therefore, because return coil spring 62 and circular cams 63 and 64 can unidirectionally be assembled in box 53 while return coil spring 62 and circular cams 63 and 64 are not fixed with the jig, assembly work of the head section constituting driving mechanism 50 is facilitated to improve productivity. Cylindrical bearing section 60 is press-fixed into attachment hole 55 after the leading end portion of rotating shaft 61 is fitted in bearing recess 56 (FIG. 8) provided in the inside surface of box 53. Therefore, cylindrical bearing section 60 abuts on the outward surface of circular cam 63 to retain rotating shaft 61. At this point, circular cams 63 and 64 abut on operating ridge 42 of plunger 40. Rubber oil seal 66 is fitted on the rear end side of rotating shaft 61 projecting from box 53, whereby setting position display panel 67 is engaged while the sealing is performed. Then the operation lever 69 is attached to the rear end of rotating shaft 61, and fixed by adjustment screw 69*a*.

After circular seal member 13 is positioned in circular rib 12, cover 14 is fixed to housing 10 by fixing screws 14*a* to complete the assembly work.

In the case that lead wires are connected to switch main body 20 on site, after cover 14 is detached, connection terminals of lead wires 70 and 71 are fixed to fixed contact terminals 27 and 28 on the lower stage side, respectively, by connection screws 24 as illustrated in FIG. 6A. Then, as illustrated in FIG. 6B, the connection terminal of lead wire 72 is fixed to fixed contact terminal 26 by connection screw 24. Finally, lead wire 73 is fixed to fixed contact terminal 25 by connection screw 24 to complete the connection work.

According to the first embodiment, a creeping distance is lengthened by partition rib 21, and first and second projections 22 and 23 act as the insulating wall. Therefore, the limit switch having an excellent insulating characteristic is obtained.

Figure 6:
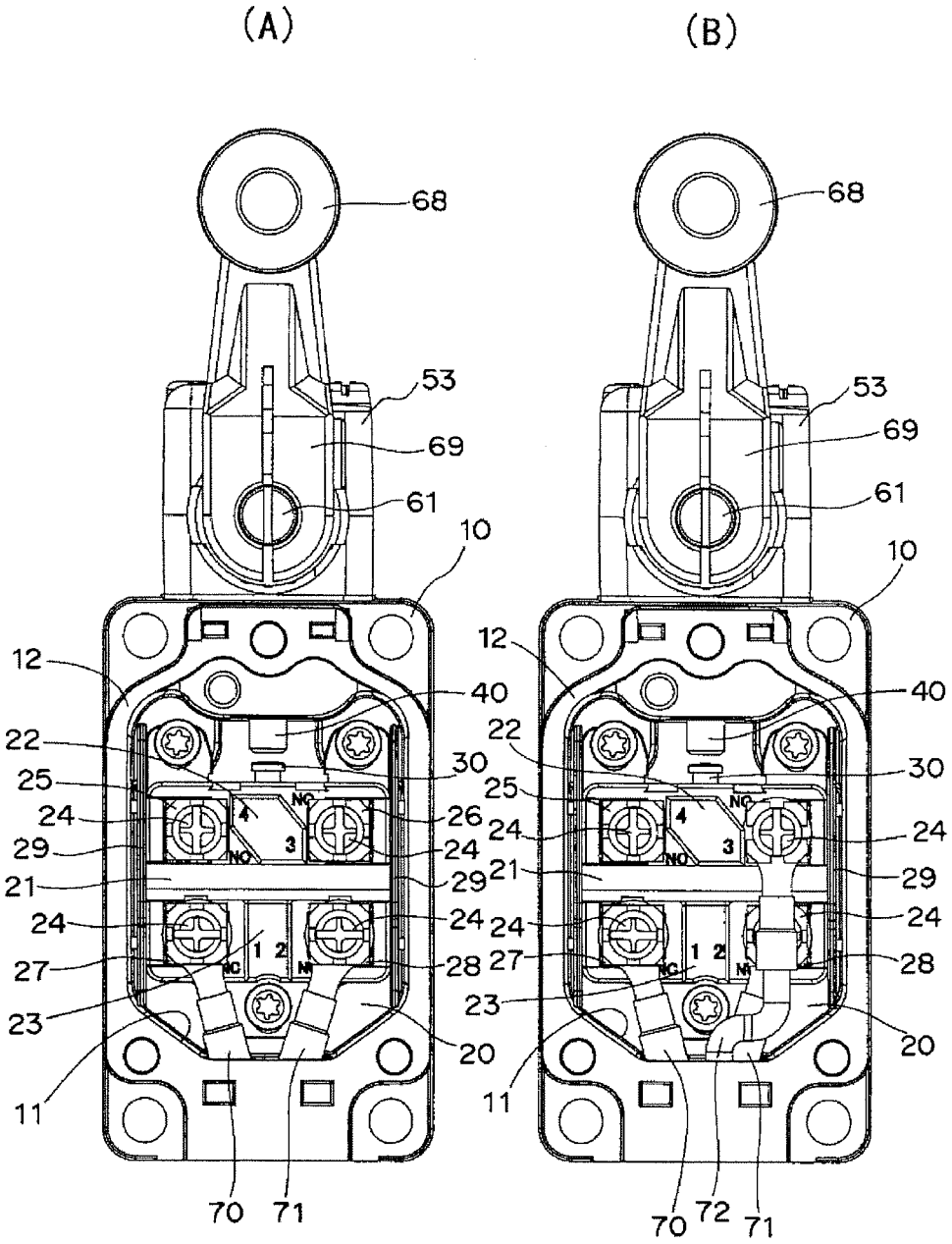
FIGS. 6A and 6B are front views illustrating a method for connecting a lead wire to the limit switch in FIG. 1.
Figure 7:
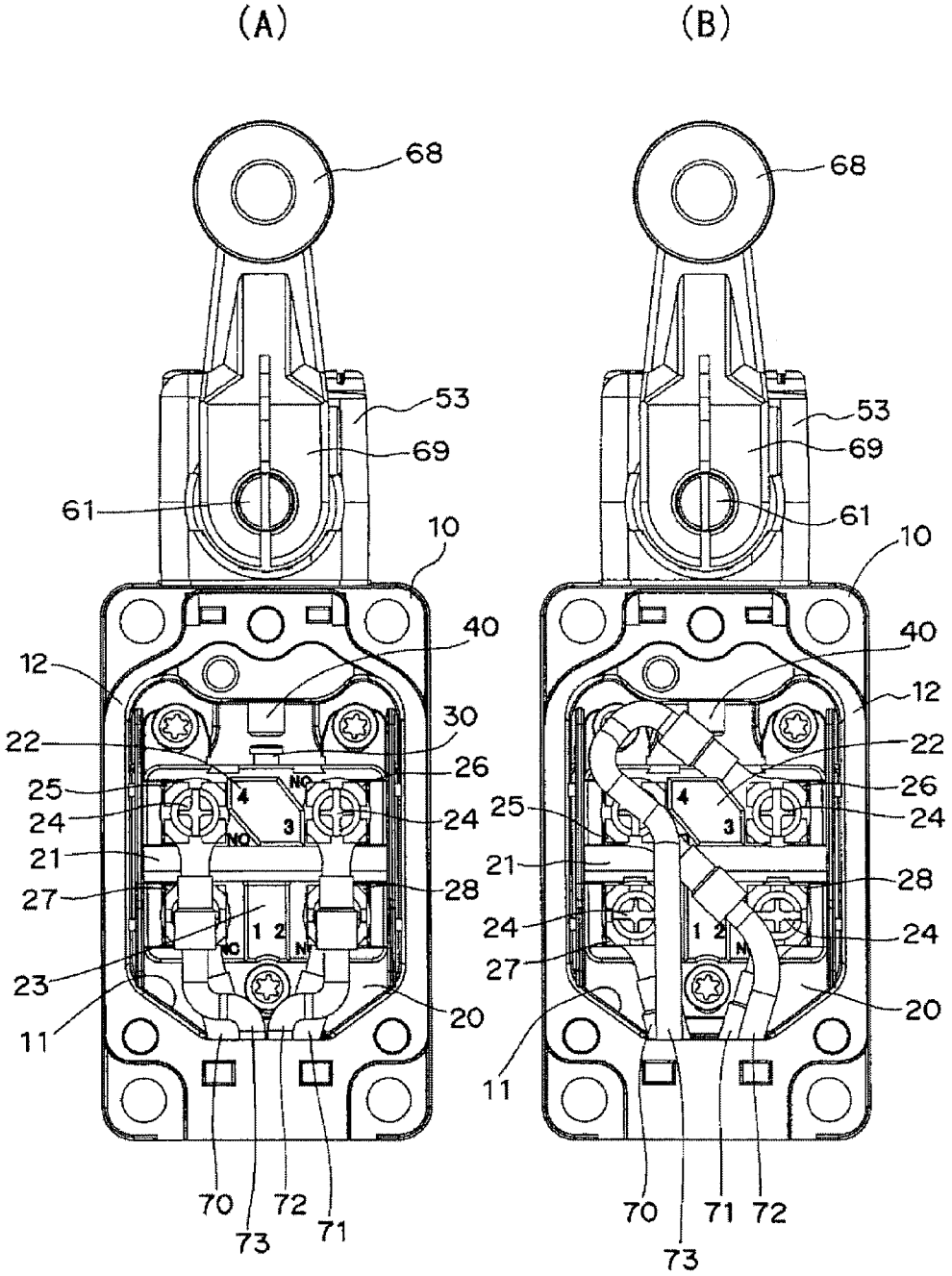
FIG. 7A is a front view continuous with FIG. 6B.
FIG. 7B is a front view illustrating another connection method.

In the case that the connection is performed by a connection structure different from that in FIG. 6, as illustrated in FIG. 7B, lead wire 72 is folded along first projection 22 and connected to fixed contact terminal 25, and lead wire 73 may be detoured along first projection 22 and connected to fixed contact terminal 26.

According to the first embodiment, an outer circumferential surface of first projection 22 has a shape (a shape, such as a substantially hexagonal shape and a substantial parallelogram, which includes a region where at least two pairs of line segments substantially parallel to each other are coupled to each other at an angle different from a right angle when first projection 22 is viewed from the front surface) along wiring routes of lead wires 72 and 73, so that advantageously the connection work can efficiently be performed.

Action of the limit switch of the first embodiment will be described below.

In the case that an external force is not applied to operation lever 69 as illustrated in FIGS. 8 and 9, operation lever 69 is vertically provided and only the pair of circular cams 63 and 64 abuts on operating ridge 42 of plunger 40, but circular cams 63 and 64 do not push down plunger 40. Therefore, operation shaft 30 is pushed up by a spring force of coil spring 31, and movable contact 33 of movable touch piece 32 is in contact with fixed contact terminals 25 and 26.

When operation lever 69 rotates clockwise by the external force, the edge on one side of flat surface 61*a* provided in rotating shaft 61 is latched in ridge 63*b* of circular cam 63. Only circular cam 63 rotates to push down operating ridge 42 of plunger 40, thereby pushing down operation shaft 30. That is, rotational action of operation lever 69 is converted into vertical action. As a result, movable touch piece 32 is pushed down and inverted, and movable contact 33 is switched from fixed contact terminals 25 and 26 to fixed contact terminals 27 and 28.

When the external load is released, rotating shaft 61 rotates in the opposite direction by the spring force of return coil spring 62, operation lever 69 returns to the original position, and operation shaft 30 and plunger 40 are pushed up by the spring force of coil spring 31.

On the other hand, when operation lever 69 rotates counterclockwise by the external force, the edge on the other side of flat surface 61*a* provided in rotating shaft 61 is latched in ridge 64*a* of circular cam 64. Only circular cam 64 rotates to push down operating ridge 42 of plunger 40, thereby pushing down operation shaft 30. As a result, movable touch piece 32 is pushed down and inverted, and movable contact 33 is switched from fixed contact terminals 25 and 26 to fixed contact terminals 27 and 28.

When the external load is released, rotating shaft 61 rotates in the opposite direction by the spring force of return coil spring 62, operation lever 69 returns to the original position, and operation shaft 30 and plunger 40 are pushed up by the spring force of coil spring 31.

In the first embodiment, guide rib 43 is engaged with selected positioning slit 17 when plunger 40 is assembled in housing 10, for example, the clockwise external force can be detected while the counterclockwise external force is not detected.

The operation lever is not necessarily attached in the vertical direction. For example, the operation lever may be attached in a horizontal or oblique direction.

In one or more of the above embodiments, the four lead wires are connected to the limit switch by way of example. Alternatively, for example, six or eight lead wires may be connected to the limit switch.

One circular cam may be attached to the rotating shaft.

One or more embodiments of the present invention can be applied to not only the limit switch but also limit switches having other shapes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

10: housing
11: opening
14: cover
15: connection hole
16: operation hole
20: switch main body
21: partition rib
22: first projection
23: second projection
24: connection screw
25, 26, 27, 28: fixed contact terminal
29: insulating wall
30: operation shaft
31: coil spring
40: plunger
41: guard portion
42: operating ridge
43: guide rib
50: driving mechanism
51: seal ring
52: fixing screw
53: box
54: cylindrical rib
55: attachment hole
56: bearing recess
60: cylindrical bearing section
61: rotating shaft
61*a*: flat surface
62: return coil spring
63, 64: circular cam
65: E-ring
65*a*: stopper
66: oil seal
67: setting position display panel

68: roller
69: operation lever
70, 71, 72, 73: lead wire

The invention claimed is:

1. A limit switch comprising:
a housing comprising a box;
an attachment hole made in a side surface of the box, having a cylindrical bearing section;
a rotating shaft rotatably inserted through the cylindrical bearing section;
a cam unit provided in a leading end portion of the rotating shaft; and
an operation lever provided in another end portion of the rotating shaft,
wherein rotational action of the operation lever is converted into vertical action by the cam unit in the box,
wherein a contact of a switch main body accommodated in and fixed to the housing is opened and closed, and
wherein an outer diameter of the cam unit is smaller than an inner diameter of the attachment hole.

2. The limit switch according to claim 1, wherein the outer diameter of the cam unit is larger than an inner diameter of the cylindrical bearing section.

3. The limit switch according to claim 2, wherein the cam unit comprises a pair of circular cams and a return spring sandwiched between the circular cams.

4. The limit switch according to claim 1, wherein the cam unit comprises a pair of circular cams and a return spring sandwiched between the circular cams.

5. A producing method of a limit switch comprising:
rotatably inserting a rotating shaft through a cylindrical bearing section in an attachment hole made in a side surface of a box partially constituting a housing,
disposing a cam unit in a leading end portion of the rotating shaft;
disposing an operation lever in another end portion of the rotating shaft;
wherein rotational action of the operation lever is converted into vertical action by the cam unit in the box,
wherein a contact of a switch main body accommodated in and fixed to the housing is opened and closed, and
wherein the producing method further comprises:
fitting the cylindrical bearing section in the attachment hole to rotatably support the rotating shaft after the rotating shaft in which the cam unit is provided in the leading end portion is inserted in the attachment hole.

* * * * *